US008293092B2

(12) United States Patent
Arzt et al.

(10) Patent No.: US 8,293,092 B2
(45) Date of Patent: Oct. 23, 2012

(54) ALKALINE ELECTROPLATING BATH HAVING A FILTRATION MEMBRANE

(75) Inventors: Karlheinz Arzt, Geislingen (DE); Jens-Eric Geissler, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 727 days.

(21) Appl. No.: 11/912,591

(22) PCT Filed: Apr. 26, 2006

(86) PCT No.: PCT/EP2006/003883

§ 371 (c)(1),
(2), (4) Date: May 22, 2008

(87) PCT Pub. No.: WO2006/114305

PCT Pub. Date: Nov. 2, 2006

(65) Prior Publication Data

US 2009/0107845 A1 Apr. 30, 2009

(30) Foreign Application Priority Data

Apr. 26, 2005 (EP) ..... 05009127

(51) Int. Cl.
*C25D 3/22* (2006.01)
*C25D 17/02* (2006.01)

(52) U.S. Cl. ..... 205/244; 205/245; 205/246; 204/252

(58) Field of Classification Search ..... None
See application file for complete search history.

(56) References Cited

U.S. PATENT DOCUMENTS

| | | | | |
|---|---|---|---|---|
| 1,981,715 | A * | 11/1934 | Atkinson | 205/265 |
| 3,974,049 | A | 8/1976 | James et al. | |
| 4,250,002 | A * | 2/1981 | Lazarz et al. | 205/523 |
| 4,421,611 | A | 12/1983 | Cameron | |
| 4,877,496 | A | 10/1989 | Yanagawa et al. | |
| 5,417,840 | A | 5/1995 | Block et al. | |
| 5,631,102 | A * | 5/1997 | Spillman et al. | 429/94 |
| 6,602,394 | B1 | 8/2003 | Hillebrand | |
| 6,652,728 | B1 | 11/2003 | Sonntag et al. | |
| 2005/0189231 | A1 * | 9/2005 | Capper et al. | 205/246 |

FOREIGN PATENT DOCUMENTS

| | | | |
|---|---|---|---|
| CA | 2054252 | A1 | 7/1992 |
| CN | 2175238 | Y | 8/1994 |
| EP | 1365046 | | 11/2003 |
| EP | 1369505 | | 12/2003 |
| JP | 11-200099 | A | 7/1999 |
| WO | WO 00/06807 | | 2/2000 |
| WO | WO 01/96631 | | 12/2001 |
| WO | 2004-108995 | | 12/2004 |
| WO | WO 2005/073438 | | 8/2005 |

OTHER PUBLICATIONS

"Daniell Cell", http://en.wikipedia.org/wiki/Daniell_cell, accessed Jul. 14, 2011.*

* cited by examiner

*Primary Examiner* — Harry D Wilkins, III
(74) *Attorney, Agent, or Firm* — Renner, Otto, Boisselle & Sklar, LLP

(57) ABSTRACT

There is described an alkaline electroplating bath for depositing zinc alloys on substrates having an anode and a cathode, wherein the anode region and the cathode region are separated from each other by a filtration membrane.

15 Claims, 1 Drawing Sheet

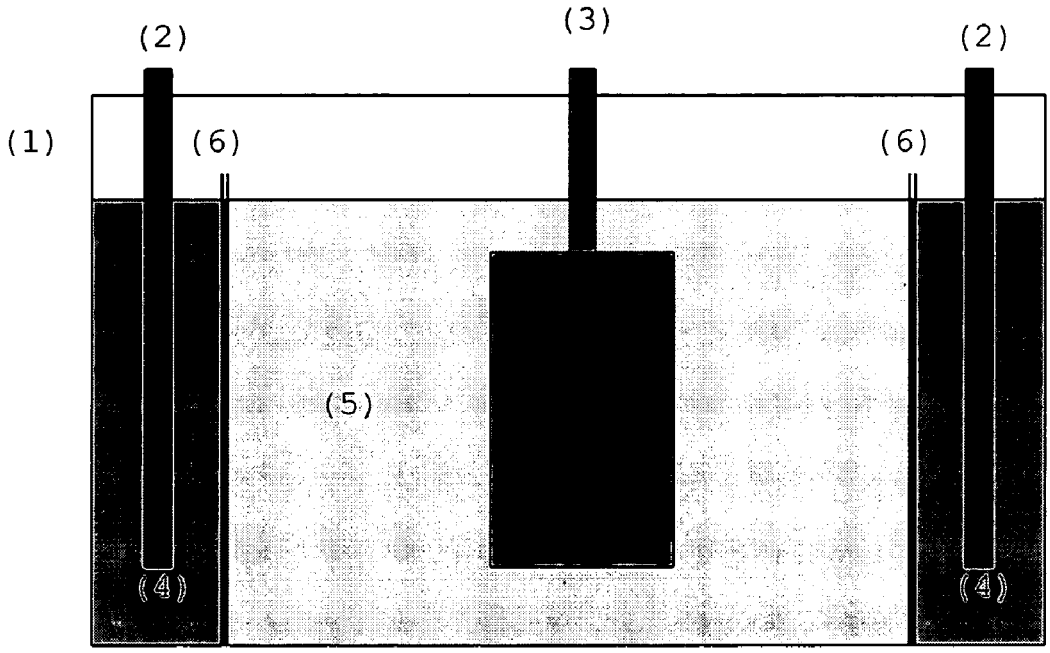
(2)
(3)
(2)
(1)
(6)
(6)
(5)
(4)
(4)

ALKALINE ELECTROPLATING BATH HAVING A FILTRATION MEMBRANE

The invention relates to an alkaline electroplating bath for depositing zinc alloys on substrates wherein the anode region and the cathode region are separated from each other by a filtration membrane. With the alkaline electroplating bath according to the invention, zinc alloys can be deposited on substrates at a constant high quality. The electroplating bath is operated on zinc alloy baths containing organic additives such as brighteners and wetting agents as well as complexing agents in addition to soluble zinc salts and, optionally, additional metal salts selected from ion, nickel, cobalt and tin salts.

In order to make it possible to deposit functional layers from zinc baths, organic brighteners and wetting agents are added to the bath. Furthermore, the bath contains complexing agents in order to make it possible to deposit further metals of the zinc alloy. The complexing agent serves to control the potential and to keep the metals in solution so that the desired alloy composition may be achieved. However, the use of the aforementioned organic components results in problems during the operation of the bath, which are described, for example, in WO 00/06807. According to this reference, it is particularly disadvantageous that these baths, after several hours of operation, show a colour changed from the original blue-violet to brown. The brown colour results from decomposition products, the amount of which increases during operation of the bath. After several weeks or months, the colouration increases. This results in considerable defects in the coating of the substrates, such as uneven layer thicknesses or blistering. Therefore, a continuous purification of the bath becomes inevitable. However, this is inefficient in terms of time and costs (see page 2, lines 3 to 10 of WO 00/06807).

Upon phase separation and with an increase in content of organic impurities, decorative defects in the coating become increasingly frequent and result in reduced productivity. In order to reduce the frequency of decorative defects, the concentration of the organic bath additives is usually increased, which results in a further increase in the content of degradation products.

Several methods are known as remedies, which are described below:

A dilution of the bath reduces the concentration of impurities in proportion to the degree of dilution. A dilution can easily be carried out; however, it has the disadvantage that the amount of electrolyte withdrawn from the bath has to be disposed off at rather high costs. In this connection, a completely new preparation of the bath can be regarded as a special case of bath dilution.

An active carbon treatment by addition of 0.5-2 g/l of active carbon to the bath and subsequent filtration reduces the concentration of impurities by adsorption on the carbon. The disadvantage of this method is that it is laborious and achieves only a relatively small reduction.

Alkaline Zn-baths have a content of organic additives which is 5 to 10 times lower than that of acidic baths. Therefore, contamination by degradation products is usually less critical. However, in the case of alkaline alloy baths the complexation of the alloy additive (Fe, Co, Ni, Sn) requires the addition of considerable amounts of organic complexing agents. These are oxidatively degraded at the anode and the accumulating decomposition products have a negative impact on the production process.

EP 1 369 505 A2 discloses a method for the purification of a zinc/nickel electrolyte in an electroplating process in which a part of the process bath used in the process is evaporated until a phase separation occurs to give a lower phase, at least one middle phase and an upper phase and the lower and the upper phases are separated. This method requires several steps and is disadvantageous in terms of the energy required and the costs involved.

WO 00/06807 and WO 01/96631 describe electroplating baths for depositing zinc-nickel coatings. In order to prevent the undesirable decomposition of additives at the anode, it is proposed to separate the anode from the alkaline electrolyte by means of an ion exchange membrane.

However, these inventions have the disadvantage that the use of such membranes is inefficient in terms of costs and maintenance.

Moreover, the electroplating baths known from WO 00/06807 and WO 01/96631 have to be operated with anolytes and catholytes which differ from each other in terms of their composition. More specifically, according to WO 00/06807, sulfuric acid solution is used as anolyte and in WO 01/96631 a basic solution, preferably sodium hydroxide, is used so that a separate anolyte circulation is required.

Moreover, the baths according to the prior art have the disadvantage that the anodic decomposition of nitrogen-containing complexing agents results in the formation of cyanide which accumulates to considerable concentrations.

The object of the invention is to provide an alkaline electroplating bath which does not have the aforementioned disadvantages. In particular, the lifetime of the bath is to be increased, the anodic decomposition of organic components of the bath is to be minimised and the use of the bath is to result in a layer thickness of constant high quality on the coated substrate.

The invention provides an alkaline electroplating bath for depositing zinc alloy on substrates having a cathode and an anode, which bath comprises a filtration membrane which separates the anode region and the cathode region of the bath from each other.

The bath according to the present invention uses filtration membranes which are known per se. Depending on the type of membrane (nano- or ultrafiltration membrane), the size of the pores of these filtration membranes generally lies in the range of 0.0001 to 1.0 μm or 0.001 to 1.0 μm. Preferably, the alkaline electroplating bath uses filtration membranes having a pore size in the range of 0.05 to 0.5 μm. Particularly preferably, the pore size lies in the range of 0.1 to 0.3 μm.

The filtration membrane contained in the alkaline electroplating bath according to the present invention can consist of various organic or inorganic, alkali resistant materials. These materials are, for example, ceramics, polytetrafluoroethylene (PTFE), polysulfone and polypropylene.

The use of filtration membranes made of polypropylene is particularly preferred.

In general, the filtration membrane in the alkaline electroplating bath according to the present invention is configured as a flat membrane. However, the alkaline electroplating bath according to the present invention can also be realised with other membrane forms, such as tubes, capillaries and hollow fibres.

Conventional zinc alloy baths can be used in the alkaline electroplating bath according to the present invention. These are usually composed as follows:

- 80-250 g/l NaOH or KOH
- 5-20 g/l zinc in the form of a soluble zinc salt
- 0.02-10 g/l of the alloy metal Ni, Fe, Co, Sn in the form of the soluble metal salts
- 2-200 g/l complexing agent selected from polyalkenylamines, alkanolamines, polyhydroxycarboxylates
- 0.1-5 g/l aromatic or heteroaromatic brighteners.

Such baths are described, for example, in U.S. Pat. Nos. 5,417,840, 4,421,611, 4,877,496 or 6,652,728.

The alkaline electroplating bath according to the present invention has the advantage that it is possible to use therein baths for the deposition of zinc alloys which are not suitable for use in the zinc-nickel bath known from WO 00/06807 and WO 01/96631 having an ion exchange membrane. In this connection, reference may be made to the bath "Protedur Ni-75" marketed by the applicant, which has a particularly high efficiency.

With a conventionally used ion exchange membrane and an anolyte of 100 g/l sulfuric acid solution, it was not possible to deposit functional layers from a freshly prepared Protedur Ni-75 bath. A bath which had already been operated for 50 Ah/l could not be operated after a further 10 Ah/l. Apparently, the process requires a certain amount of anodically produced degradation products which are prevented by the use of ion exchange membranes.

It was found in experiments with a filtration membrane that, from a pore size of 0.2 μm, even in this type of bath, a sufficient amount of degradation products is formed in order to ensure a smooth operation. In these experiments, the efficiency was even higher than without filtration membrane and the consumption of organic additives was markedly lower. In this connection, see Table 1.

TABLE 1

| Protedur Ni-75 | without filtration membrane | with filtration membrane |
|---|---|---|
| Efficiency: | 64% | 73% |
| Consumption of replacement solution | 4.5 l/10,000 Ah | 2.8 l/10,000 Ah |
| Consumption of brightening additive | 3.0 l/10,000 Ah | 1.7 l/10,000 Ah |
| Consumption of throwing agent | 1.1 l/10,000 Ah | 0.8 l/10,000 Ah |

Anodes previously employed can be used in the alkaline electroplating bath according to the present invention. These are usually nickel anodes. The use of these anodes is more cost efficient compared to the electroplating bath known from WO 00/06807 in which special platinised titanium anodes must additionally be used.

The invention will be illustrated in more detail by the appended drawings:

FIG. 1 shows a schematic representation of the electroplating bath according to the present invention. Herein, (1) designates the bath, (2) the anodes and (3) the cathode or the substrate to be plated. Furthermore, there are shown the anolyte (4) surrounding the anode and the catholyte (5) surrounding the cathode. Anolyte and catholyte are separated from each other by a filtration membrane (6). The filtration membrane makes it possible to operate the bath, but, at the same time, limits the decomposition of the organic components in the catholyte, in particular, of the complexing agent, by migration to the anode or into the anode region. The reaction of the complexing agents at the anode is limited, i.e., their conversion to carbonates, oxalates, nitrils or cyanides is limited. Therefore, no phase separation is observed when the electroplating bath according to the present invention is operated. Thus, a continuous purification of the bath is not required.

In the bath according to the present invention, the anode region is preferably configured so as to be smaller than the cathode region because the essential processes take place there.

The invention will be illustrated in more detail by the following examples.

EXAMPLES

A bath for the deposition of zinc-nickel alloys having the composition indicated below was first operated at a throughput of 5 Ah/l so that the initially increased consumption at the beginning of the operation of the bath stabilised. This prevents undesirable deposition processes. This bath will hereinafter be referred to as "new batch".

It consists of the following components:

Zinc 10.4 g/l (as soluble ZnO)
Nickel 1.2 g/l (as nickelsulfate)
NaOH 120 g/l
Quadrol 35 g/l
Pyridinium-N-propane-3-sulfonic acid 1.25 g/l
Polyethyleneimine 5 g/l Furthermore, a bath of the same type was used which had already been operated for some time, i.e., which had a throughput of >1000 Ah/l. This bath will hereinafter be referred to as "old batch".

Both baths were each operated in 5-1 tanks with and without filtration membrane. As a filtration membrane, there was used the polymer membrane P150F which is available from Abwa-Tec and which has a pore size of 0.12 μm. The membrane was introduced into the bath between the anode and the cathode, the anolyte and catholyte being of identical composition, i.e., no special anolyte was added. Subsequently, iron sheets (7×10 cm), which are conventionally used for Hull cell tests, were employed as substrates to be plated and these were plated at a current density of 2 A/dm$^2$. The baths were operated in a serial connection. The iron sheets were moved mechanically at a rate of 1.4 m/min.

The baths were then analysed and supplemented at regular intervals. The post-dosing of the baths was carried out according to the results of the Hull cell tests after about 5 Ah/l. An entrainment of 12 l of bath/10,000 Ah, which is common in productive baths, was also taken into account and the bath components were replaced accordingly.

Table 2 shows the Hull cell layer thickness for a new batch and an old batch as a function of throughput, with and without filtration membrane. The layer thicknesses were determined after adjustment of the baths.

Measurements were carried out at points of high current density as well as at points of low current density. The points lie on the Hull cell sheets 3 cm from the lower edge and 2.5 cm from the left- or right-hand side edges. The high current density (point A) is on the left-hand side and the low current density (point B) is on the right-hand side.

TABLE 2

| Hull cells: | New batch without filtration membrane | | New batch with filtration membrane | | Old batch without filtration membrane | | Old batch with filtration membrane | |
|---|---|---|---|---|---|---|---|---|
| 1Ax10 min | Point A | Point B | Point A | Point B | Point A | Point B | Point A | Point B |
| 0-Probe | 3.00 | 1.00 | 3.00 | 1.00 | 2.00 | 0.80 | 2.00 | 0.80 |
| 5 Ah/l | 2.65 | 1.10 | 3.20 | 1.25 | 2.10 | 0.95 | 2.20 | 0.95 |
| 10 Ah/l | 2.55 | 1.05 | 3.25 | 1.20 | 2.30 | 0.90 | 2.40 | 0.95 |
| 15 Ah/l | 2.50 | 1.00 | 3.20 | 1.15 | 2.40 | 0.90 | 2.60 | 0.95 |

TABLE 2-continued

| Hull cells: | New batch without filtration membrane | | New batch with filtration membrane | | Old batch without filtration membrane | | Old batch with filtration membrane | |
|---|---|---|---|---|---|---|---|---|
| 1Ax10 min | Point A | Point B | Point A | Point B | Point A | Point B | Point A | Point B |
| 20 Ah/l | 2.60 | 0.95 | 3.30 | 1.20 | 2.30 | 0.85 | 2.60 | 0.95 |
| 25 Ah/l | 2.65 | 0.90 | 3.45 | 1.10 | 2.25 | 0.80 | 2.55 | 0.90 |
| 30 Ah/l | 2.55 | 1.00 | 3.40 | 1.20 | 2.25 | 0.85 | 2.65 | 0.95 |
| 35 Ah/l | 2.50 | 1.05 | 3.35 | 1.20 | 2.30 | 0.90 | 2.75 | 1.00 |
| 40 Ah/l | 2.30 | 0.95 | 3.50 | 1.15 | 2.20 | 0.85 | 2.85 | 1.05 |
| 45 Ah/l | 2.20 | 0.90 | 3.65 | 1.10 | 2.00 | 0.80 | 2.95 | 1.00 |
| Average: | 2.50 | 0.99 | 3.37 | 1.17 | 2.23 | 0.87 | 2.62 | 0.97 |
| Increase | | | 35% | 19% | | | 17% | 12% |

Surprisingly, it was found that in the case of the new batch without filtration membrane, the layer thickness decreases, whereas, in the case of the old batch with filtration membrane, it continuously increases.

When a filtration membrane is used, the average layer thickness for a new batch in the high current density region is about 35% greater and in the low current density region it is about 19% greater than if one had not used a filtration membrane. With an old batch, it is, on average, 17% and 12% greater, respectively, than without filtration membrane.

Surprisingly, if a filtration membrane is introduced into an old batch after a throughput of >1000 Ah/l, a current efficiency which is comparable to that of a new batch is obtained after a short time.

Table 3 shows the average consumption (1/10,000 Ah) of the electrolyte in the bath for electroplating baths with filtration membrane according to the present invention and for such baths which do not have this membrane. By the use of the filtration membrane, the consumption of organic components was lowered by 12 to 29%, depending on the additive.

TABLE 3

| Reflectalloy ZNA: | Complexing agent | Brightener |
|---|---|---|
| Without filtration membrane | 4.1 | 2.8 |
| With filtration membrane | 3.6 | 2.0 |
| Difference: | −12% | −29% |

Complexing agent: Quadrol, polyethyleneimine

Brightening agent: pyridine-N-propane-3-sulfonic acid

The composition of the aforementioned bath was analysed according to the tests described above. Their cyanide content was of particular interest. When a bath according to the present invention having a filtration membrane was used, this content was much lower than with baths without membrane. As shown in the following Table 4, a bath without the membrane had a cyanide content of 680 mg/l (new batch) or 790 mg/l (bath with >1000 Ah/l), whereas the corresponding bath with a membrane had a cyanide content of 96 mg/l and 190 mg/l, respectively.

Surprisingly, it was found that the cyanide content of an old batch, i.e., a bath with >1000 Ah/l, can be reduced when this is provided with and operated with a filtration membrane. For example, the cyanide content of such a bath was reduced from 670 mg/l to 190 mg/l.

TABLE 4

| Total cyanide: | Starting value | after 50 Ah/l with filtration membrane | after 50 Ah/l without filtration membrane |
|---|---|---|---|
| New batch (after 5 Ah/l) | 33 mg/l | 96 mg/l | 680 mg/l |
| Old batch (>10,000 Ah/l) | 670 mg/l | 190 mg/l | 790 mg/l |

When conducting the test described above, the colour of the bath was also assessed. This lead to the finding that the colour of a freshly prepared bath without membrane changed from an initial violet-orange to brown within 15 Ah/l, whereas, when a filtration membrane was used, it remained violet or violet-orange over the entire period. The old batch remained brown when no membrane was used and when a membrane was used the colour changed to orange-brown after 15 Ah/l. Violet is also the colour of freshly prepared baths which then changes to orange (after several Ah/l) and, at high throughput, to brown.

Finally, the voltage between anode and cathode was measured. It was about 3 V and, in both batches, was only about 50-100 mV higher, when a filtration membrane was used. When an ion exchange membrane as described in WO 00/06807 is used instead of the filtration membrane, the voltage is at least 500 mV greater. This again shows the advantage of the use of a filtration membrane instead of an ion exchange membrane.

In summary, it was found that the use of a filtration membrane has many advantages compared to the use of an ion exchange membrane. Thus, the plating process conducted therewith is more cost-efficient because no platinised anodes must be used, catholyte and anolyte can have the same composition and, therefore, no circulation for the anolyte is required.

Compared to the operation of an electroplating bath without membrane, the current efficiency is higher and the consumption is lower. Moreover, degradation products and, in particular, cyanide, can be reduced or their concentration can be lowered and the quality of the layers deposited from the bath can be improved.

List of Reference Signs (1) Alkaline electroplating bath (2) Anode (3) Cathode (4) Anolyte (5) Catholyte (6) Filtration membrane

The invention claimed is:

1. Alkaline electroplating bath for depositing zinc alloys on substrates having an anode and a cathode, wherein the anode region and the cathode region are separated from each other by a filtration membrane, wherein the filtration membrane consists of polysulfone, and wherein the size of the pores of the filtration membrane is in the range of 0.0001 to 1.0 μm.

2. Alkaline electroplating bath according to claim 1, wherein the size of the pores of the filtration membrane is in the range of 0.1 to 0.3 μm.

3. A process for the deposition of zinc alloys on substrates, wherein the substrate is introduced as the cathode in an alkaline electroplating bath according to claim 2 and the substrate is electroplated with the zinc alloy.

4. Alkaline electroplating bath according to claim 1, wherein the filtration membrane is configured as a flat membrane.

5. A process for the deposition of zinc alloys on substrates, wherein the substrate is introduced as the cathode in an alkaline electroplating bath according to claim 4 and the substrate is electroplated with the zinc alloy.

6. Alkaline electroplating bath according to claim 1, wherein the anolyte in the anode region has the same composition as the catholyte in the cathode region.

7. A process for the deposition of zinc alloys on substrates, wherein the substrate is introduced as the cathode in an alkaline electroplating bath according to claim 6 and the substrate is electroplated with the zinc alloy.

8. A process for the deposition of zinc alloys on substrates, wherein the substrate is introduced as the cathode in an alkaline electroplating bath according to claim 1 and the substrate is electroplated with the zinc alloy.

9. A process according to claim 8, wherein the electrolyte used is a solution comprising the following components:

80-250 g/l NaOH or KOH 5-20 g/l zinc in the form of the soluble zinc salt 0.02-10 g/l of the alloy metal Ni, Fe, Co, Sn in the form of the soluble metal salts 2-200 g/l complexing agent selected from polyalkenylamines, alkanolamines polyhydroxycarboxylates 0.1-5 g/l aromatic or heteroaromatic brightening agents.

10. A process according to claim 8, wherein the plating is carried out at a temperature of 10 to 60° C.

11. A process according to claim 8, wherein the bath is operated at a current density of 0.25 to 10 $A/dm^2$.

12. A process according to claim 8, wherein the bath is operated at a current density of 1 to 3 $A/dm^2$ .

13. A process according to claim 8, wherein the plating is carried out at a temperature of 20 to 30° C.

14. A process for separating an alkaline electroplating bath having an anode and a cathode into an anode region and a cathode region, for increasing the lifetime of the bath, for preventing the anodic decomposition of organic components of the bath and for obtaining layers of constant high quality, comprising placing a filtration membrane between the anode and the cathode, wherein the filtration membrane consists of polysulfone, and wherein the size of the pores of the filtration membrane is in the range of 0.0001 to 1.0 μm.

15. A method for preventing anodic decomposition of organic components of an alkaline electroplating bath having an anode and a cathode and for obtaining layers of constant high quality, the method comprising separating the anode and cathode with a filtration membrane to form an electroplating bath having an anode region and a cathode region, wherein the filtration membrane consists of polysulfone, and wherein the size of the pores of the filtration membrane is in the range of 0.0001 to 1.0 μm.

* * * * *